United States Patent [19]

Morris et al.

[11] 4,265,324

[45] May 5, 1981

[54] ECCENTRIC COUNTERBORE FOR DIAMOND INSERT STUD

[75] Inventors: John F. Morris, Westminster; Robert V. Worrell, Irvine, both of Calif.

[73] Assignee: Smith International, Inc., Newport Beach, Calif.

[21] Appl. No.: 98,462

[22] Filed: Nov. 29, 1979

[51] Int. Cl.[3] ..... E21B 10/46

[52] U.S. Cl. ..... 175/329; 175/410; 175/413

[58] Field of Search ..... 175/329, 330, 391, 410, 175/413

[56] References Cited

U.S. PATENT DOCUMENTS

| | | | |
|---|---|---|---|
| 1,041,568 | 10/1912 | Bade | 175/330 |
| 2,780,439 | 2/1957 | Kandle | 175/413 X |
| 3,143,177 | 8/1964 | Golorneau | 175/413 |
| 4,073,354 | 2/1978 | Rowley et al. | 175/329 |
| 4,199,035 | 4/1980 | Thompson | 175/410 |

*Primary Examiner*—James A. Leppink
*Assistant Examiner*—Richard E. Favreau
*Attorney, Agent, or Firm*—Robert G. Upton

[57] ABSTRACT

Conventional drag bits for diamond insert studs generally require a two-step operation which includes a first drilled hole to accept the grip length of the diamond stud. A second counterboring operation relieves the upper portion of the bored hole to clear the bottom edge of the diamond cutting face of the insert. Counterboring also facilitates insertion of the studs within the hole. Conventional insertion methods for the studs unfortunately leave a portion of the insert vulnerable to breakage because the back side of the insert opposite the cutting face is unsupported. This invention corrects this problem by drilling the counterbore hole eccentrically with respect to the insert hole so that the counterbore surface is, for example, tangent with the insert hole at a point opposite the cutting face of the insert stud, thus providing support for the upper portion of the stud during operation of the drag bit.

5 Claims, 5 Drawing Figures

ECCENTRIC COUNTERBORE FOR DIAMOND INSERT STUD

BACKGROUND OF THE INVENTION

1. Field of the Invention

This invention relates to diamond insert drag bits and a method to interference fit the inserts within the face of the bit.

More particularly, this invention relates to diamond insert drag bits wherein the insert boring operation results in additional support for the shank of the insert interference fitted within the face of the bit.

2. Description of the Prior Art

State of the art methods to insert diamond insert studs within the face of a drag bit body result in a concentric counterbored hole to relieve an area surrounding the insert body to clear the bottom edge of the cutting face of the diamond insert.

Each of the multiplicity of diamond inserts utilized in a typical drag bit is so oriented in the face portion of the drag bit to maximize borehole penetration. In other words, the cutting face of each insert is positioned to cut a specific area on the borehole bottom to maximize hole penetration.

Experience has shown that some of the strategically positioned diamond insert studs supprting the diamond cutting face of the inserts have a tendency to fracture just above the grip length of the studs during operation of the bit.

Heretofore there has been no means provided to backup the upper portion of the insert stud body above the grip length of the insert.

Therefore, state of the art diamond insert drag bits are disadvantaged in that each of the multiplicity of inserts is vulnerable to breakage just above the top of the grip length of the insert studs.

The present invention overcomes this disadvantage by counterboring each insert hole in an eccentric manner. The eccentric counterbore hole, for example, substantially tangents the insert hole at a point 180° from the orientation of the cutting tip of each of the inserts, thus providing backup support for the portion of the shank of the insert that normally is unsupported in conventional concentric counterboring operations.

SUMMARY OF THE INVENTION

It is an object of this invention to provide a means for backup support for each of a multiplicity of diamond insert studs positioned in the face of a diamond drag bit.

More specifically, it is an object of this invention to counterbore insert retention holes eccentrically so that the counterbore hole substantially tangents the insert retention hole at a point opposite the cutting face of each diamond insert, thus providing additional support for the upper portion of the insert.

A diamond drag bit is disclosed wherein the drag bit has a multiplicity of individual diamond insert studs strategically inserted within interference fit insert holes formed in a face of the drag bit to maximize hole penetration of the bit. The insert holes are counterbored to clear a diamond cutting face of the insert studs.

Means to support the diamond insert stud at a point opposite to the diamond cutting face is provided by counterboring each of the insert holes eccentrically within the face of the bit. The eccentrically relieved portion formed in the drag bit face is so positioned to provide support for a shank of the insert stud opposite to the cutting face of the diamond insert. The placement of the eccentrically relieved portion is dependent upon the orientation of the cutting face of the diamond insert.

An advantage then over the prior art is the means in which the shank of the diamond insert is supported within the face of a diamond drag bit while relieving a portion of the face of the drag bit surrounding the insert to clear the diamond cutting face of the insert.

The above noted objects and advantages of the present invention will be more fully understood upon a study of the following description in conjunction with the detailed drawings.

DESCRIPTION OF THE PREFERRED EMBODIMENTS AND BEST MODE FOR CARRYING OUT THE INVENTION

Figure 1:
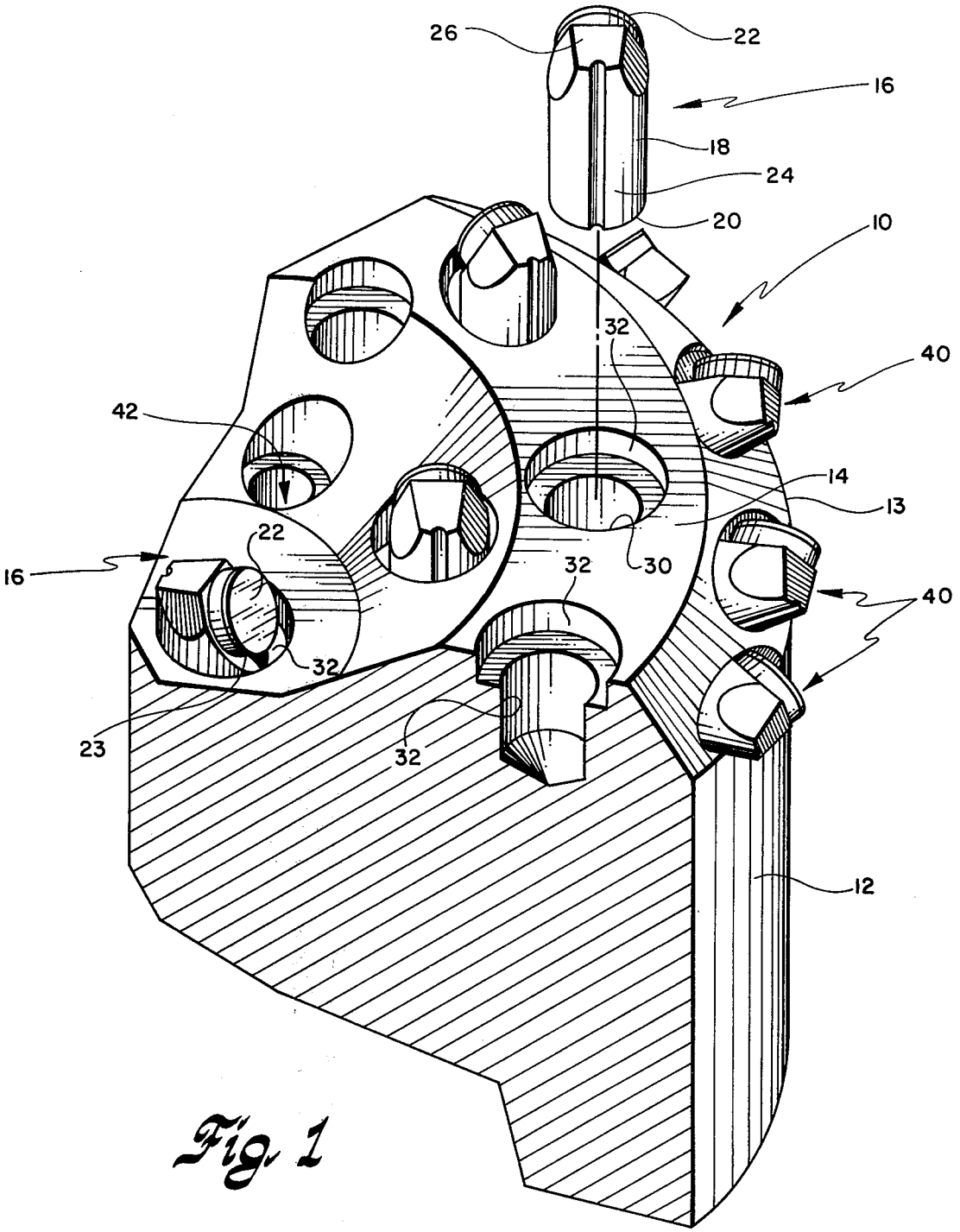
FIG. 1 is a partially broken-away perspective view of a diamond drag bit illustrating the eccentric counterbore drilling method to clear the bottom edge of the cutting face of the diamond insert.

Turning to FIG. 1, the diamond drag bit, generally designated as 10, consists of a drag bit body 12 which forms a face 14 at one end of the body and a pin end at the other (not shown). A multiplicity of diamond inserts, generally designated as 16, are inserted in insert holes 30 formed in the face 14 of bit body 12. The insert blanks 16, for example, are fabricated from a tungsten carbide substrate with a diamond layer sintered to a face of a substrate, the diamond layer being composed of a polycrystalline material. The synthetic polycrystalline diamond layer is manufactured by the Specialty Material Department of General Electric Company of Worthington, Ohio. The foregoing drill cutter blank, or diamond insert, is known by the trademark name of Stratapax drill blanks. The series of inserts 16 are strategically placed within face 14 of drag bit body 12 to best advance the drill bit in a borehole. A series of diamond inserts 40 are positioned around the peripheral edge 13 of bit body 12 to cut the gage of the borehole. Interference fit insert hole 30 is drilled in the face 14 of the bit to accept the full grip length 18 of insert 16. The deeper the insert 16 is inserted within the face of the drag bit, the more support provided to the shank 18, or grip length, of the drag bit. However, by setting the inserts deep within their interference holes 30 the bottom edge 23 of the cutting disc 22 interferes with the top face surface 14 of the drag bit 10. Thus it is necessary to counterbore the insert hole to clear or relieve the bottom cutting 23 of the diamond disc 22.

Figure 2:
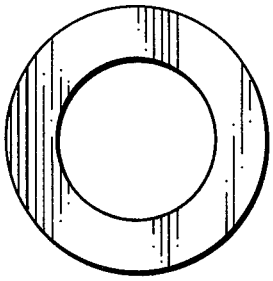
PRIOR ART Fig. 2
FIG. 2 is illustrative of the prior art wherein the counterbore to clear the diamond face of the insert is concentric with the insert hole.

With reference now to the prior art shown in FIG. 2, the state of the art method included a concentric counterbore operation which relieved the upper surface of the insert hole 360° around the top of the inserts. The concentric counterbore hole also relieved the back surface opposite the cutting face of the inserts a distance at least the depth of the counterbore thereby removing support for the diamond insert shank.

With reference again to FIG. 1, by counterboring the insert holes eccentrically so that only that portion which has to be relieved to clear the bottom cutting edge of the diamond disc 22 is relieved, the back portion 24 of the inserts 16, 180° from cutting disc 22, is supported at least the distance from the bottom of the counterbore to the face 14 of the drag bit body 12.

Figure 3:
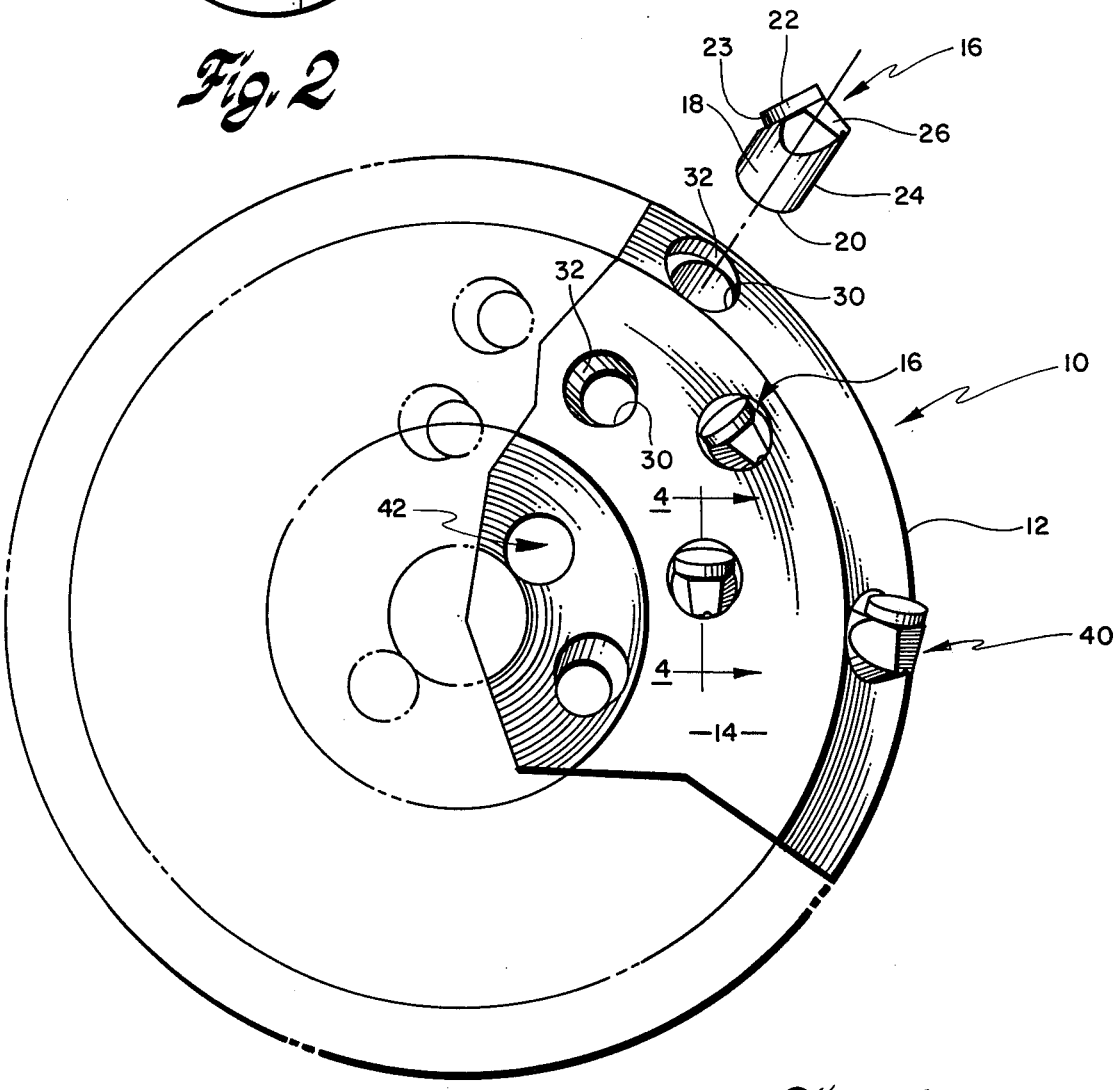
FIG. 3 is a partially cut-away end view of the face of the drag bit illustrating the orientation of the insert holes and the eccentric counterbore relief portions in the face of the bit.

Turning now to FIG. 3, this top view illustrates the orientation of each of the diamond inserts 16 within the face 14 of the bit body 12. The eccentric countersunk portion 32 is oriented with respect to the orientation of the insert within the face of the bit. The specific positioning of the countersunk area assures the maximum support of the shank 18. Specifically, the back portion of the shank 24 is supported a maximum distance around the circumference of the shank.

Figure 5:
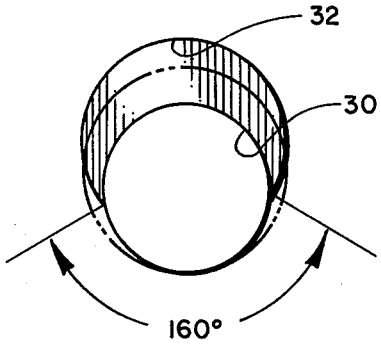
FIG. 5 is an enlarged view of the insert hole formed in the drag bit and eccentric counterbore relieved portion in the bit face showing additional support for the back surface of the insert.

FIG. 5 illustrates the eccentricity of the countersunk area 32 with respect to the insert hole 30. The back portion of the shank 18, specifically designated as 24, is supported at least 160° around the circumference of the insert.

It would be obvious to position the countersunk area 32 so that the back portion of the countersunk area tangents the back side of the insert hole at a point exactly 180° from the cutting face 22 of insert 16. If the countersunk hole 32 intersects or tangents the portion of the insert hole 30 one hundred and eighty degrees from the orientation of the cutting face of the insert, the back side 24 of insert 16 would be supported at least 25% to 50% of the circumference of the shank 18 or grip length.

Figure 4:
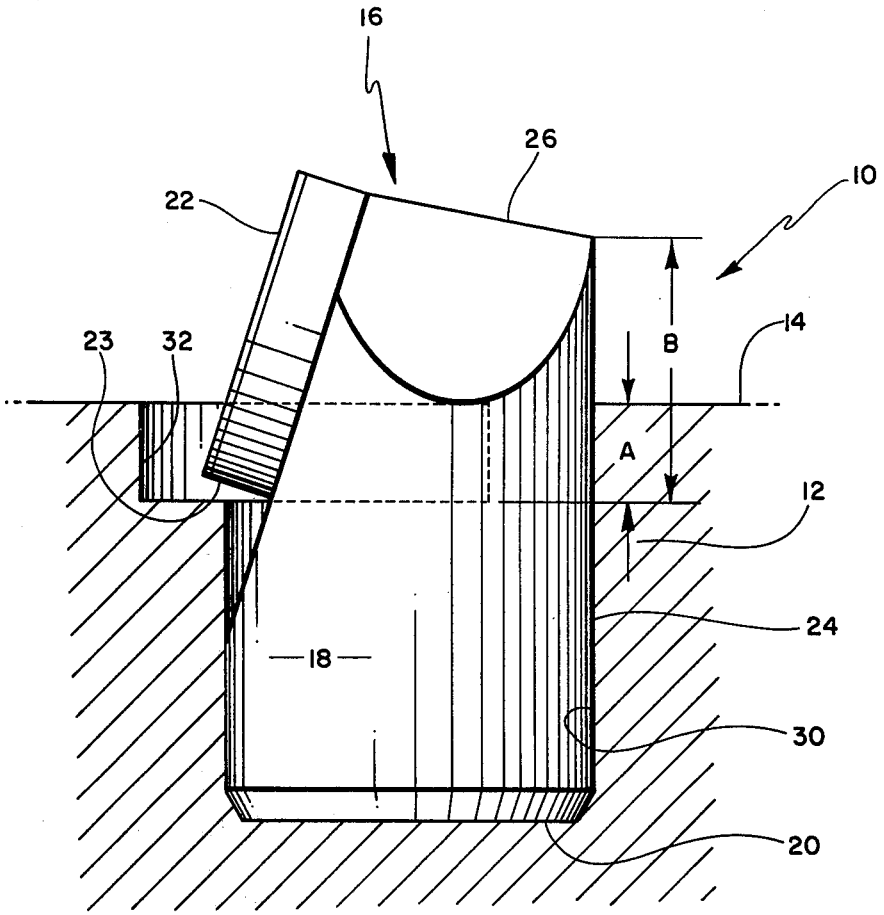
FIG. 4 is a view taken through 4—4 of FIG. 3 showing a partially cut-away side view of an insert stud inserted in the face of the drag bit.

With reference to FIG. 4, this view clearly illustrates the relationship of the insert 16 within the face 14 of bit body 12. If, for example, each of the diamond inserts 16 was inserted within face 14 of bit body 12 without the countersunk portion to relieve an area adjacent the bottom edge 23 of the diamond cutting face 22, a portion designated as "B" would, of course, be above the face 14 of the insert and thus unsupported. The section designated as "A" is exposed to the hole bottom and the insert would be in danger of fracturing along a line substantially even with the bottom edge 23 of diamond face 22. By eccentrically counterboring each insert hole, the back side 24 of insert grip area 18 is supported the additional distance designated as "A", thus providing backup for the cutting face 22 of each of the inserts and therefore greatly minimizing any tendency to fracture along a line substantially even with the face 14 of insert body 12.

As stated before, the degree of support for back side 24 of grip length 18 is determined by the diameter and the amount of eccentricity of the counterbore operation. For example, these parameters may be varied to give additional support "A" from 5° to 180° around the diameter of the insert 16 (FIG. 4).

It will of course be realized that various modifications can be made in the design and operation of the present invention without departing from the spirit thereof. Thus, while the principal preferred construction and mode of operation of the invention have been explained in what is now considered to represent its best embodiments, which have been illustrated and described, it should be understood that within the scope of the appended claims, the invention may be practiced otherwise than as specifically illustrated and described.

We claim:

1. A diamond drag bit apparatus wherein said drag bit has a multiplicity of individual diamond inserts strategically inserted within insert holes formed in a face of said drag bit, said diamond inserts having a diamond cutting disc at a first cutting end and a shank portion at an opposite end, said drag bit comprising:

means to provide additional support for said cutting end of said insert along a longitudinal surface of said insert shank substantially opposite to said diamond cutting disc attached to said shank at said first cutting end by relieving a portion of said drag bit face near said insert hole formed in said face to clear an edge of said disc nearest said face of said drag bit so that said shank may be inserted deeper into said insert hole, said relieved portion is provided by eccentrically counterbore drilling each of said insert holes, said counterbore being so positioned to provide relief clearance for an edge of said cutting disc nearest said face of said drag bit while leaving said insert shank with backup material substantially opposite to said cutting disc of said insert, said relieved portion of said insert hole being so positioned dependent upon said strategic orientation of said cutting disc of said insert relative to said face of said drag bit.

2. The invention as set forth in claim 1 wherein said support for a shank of said insert is from 5° to 180° of said shank of said insert opposite to said cutting disc of said diamond insert.

3. The invention as set forth in claim 1 wherein said support for a shank of said insert is about 160° opposite to said cutting disc of said diamond insert.

4. The invention as set forth in claim 1 wherein said eccentric counterbored hole substantially tangents said insert hole formed by said face of said bit at a point substantially opposite to said cutting disc of said diamond insert.

5. The invention as set forth in claim 1 wherein said eccentric counterbored hole relieves said material surrounding said insert hole to provide clearance for said cutting disc of said insert nearest said face of said drag bit while leaving from 25% to 50% of said material surrounding said insert hole in an area substantially opposite to said cutting disc of said diamond insert.

* * * * *